US005855098A

United States Patent [19]

Bromer

[11] Patent Number: 5,855,098

[45] Date of Patent: Jan. 5, 1999

[54] SPIRAL PATENT OFFICE

[76] Inventor: Nicholas Bromer, 6812 Westmoreland Ave., Takoma Park, Md. 20912

[21] Appl. No.: 909,064

[22] Filed: Aug. 14, 1997

Related U.S. Application Data

[60] Provisional application No. 60/024,007, Aug. 15, 1996.

[51] Int. Cl.[6] ..... E01F 9/00

[52] U.S. Cl. ..... 52/175; 52/236.2

[58] Field of Search ..... 52/234, 236.2, 52/236.1, 236.4, 79.2, 79.3, 175, 176

[56] References Cited

U.S. PATENT DOCUMENTS

| | | | |
|---|---|---|---|
| 489,964 | 1/1893 | Lehmann | 52/175 |
| 1,834,297 | 12/1931 | Vojacek | 52/176 |

FOREIGN PATENT DOCUMENTS

| | | | |
|---|---|---|---|
| 1434561 | 11/1968 | Germany | 52/175 |
| 4215742 | 11/1993 | Germany | 52/175 |
| 510569 | 6/1976 | U.S.S.R. | 52/236.2 |
| 1604979 | 11/1990 | U.S.S.R. | 52/175 |
| 93009315 | 5/1993 | WIPO | 52/175 |

OTHER PUBLICATIONS

Architectural Forum, vol. 97, p. 13 [See Drawing Figure], Jun. 1950.

*Primary Examiner*—Creighton Smith

[57] ABSTRACT

A building for housing an ordered collection of items—for example, a library, archive, or patent office—places the items along a spiral arm (1), and makes the items easily movable with wheeled cases, so that the collection can grow. Preferably the spiral is housed in a spiral building arm starting at a central building (2) and winding outward, with interconnecting legs (2) providing access to the far reaches of the arm. The building never becomes too small because the end (E) of the building can be extended gradually. As the collection grows, the cases are merely pushed along to make room as needed. The collection never gets out of order.

17 Claims, 4 Drawing Sheets

SPIRAL PATENT OFFICE

CROSS-REFERENCE TO RELATED APPLICATION

This application claims the benefit of U.S. Provisional Application Ser. No. 60/024,007 filed on Aug. 15, 1996.

FIELD OF THE INVENTION

The present invention relates to the geometry of buildings, especially those housing archives or collections.

REVIEW OF THE RELATED TECHNOLOGY

Most buildings have a fixed size, and that is satisfactory for most building uses because if the building becomes too small another one can be built. But growth can cause problems, especially when archives or ordered collections are housed in a conventional building.

The best example is the U.S. Patent and Trademark Office (PTO), which is perhaps the largest archival organization in the world. The trademark operation is relatively small, but the patent office is huge and growing. In a year the number of patents, now at about 5.6 million, increases by 105 thousand; a growth rate of almost 2 percent. The growth rate itself is increasing, so that the number of patents is increasing faster than exponentially. The patent office is doubling in size every 35 years at the current 2% rate.

This growth has caused problems for the following reason:

The patents and their scheme of classification are the core around which is built the parallel organization of patent examiners. The approximately 2000 examiners who issue new patents constantly use the collection to search the already-issued patents. The patent classification scheme allows the Patent Office to function by organizing and relating the many fields of technology and thereby dividing up the examining work in an organized manner. Because examiners constantly search the patent files they need to be physically near their particular section of the patent collection. Thus, both the patent collection and its classification scheme are very important to the operation of the patent office.

The patent office has run out of room and the patent collection is now becoming more and more jumbled as overflow is shunted off to new patent cases in odd corners. Overflow is placed where room can be found, which is usually far from the place of origin. Future technologies cannot be predicted, and neither can growth of the patent collection; some areas are stagnant, others are explosive. This erratic growth further fragments and disorders the physical locations of the patent collection.

For example, computers were originally made from electric relays, but today the relay patent classes are not even in the same building with computer patents.

The classification scheme itself is starting to break down, too, making it more difficult to find the correct classification of patents relevant to a given invention. An example is patent class 128 (surgery), which became too big. Since there was already a class 129, class 128 split into classes 128, 600, 602, 604, and 606.

For years, the talk has been that computers will do away with the paper patent collection. However, like "artificial intelligence", this has not happened despite the computer enthusiasts' optimism. The patent office will probably depend on its paper collections well into the next century.

The patent office moved 30 years ago to more spacious offices, two large buildings in an office complex called Crystal City, but now it occupies 18 buildings there and is in the process of moving again because of crowding. The specifications set out for the new patent office building include 70,000 square feet of reserve patent storage space, but it is easily calculated that this reserve patent space will be filled up just 28 years after the new buildings are completed.

The problems in the patent office are shared, to a lesser degree, by many other collections, libraries, and archives. A large collection of any items, be they books, archeological artifacts, or museum exhibits, will surely in time overflow the building housing them if the collection steadily grows. Then the library, museum, or organization will be split between two buildings. Worse, the collection will need to be constantly shifted even if the growth is even throughout the collection; like a gas it expands everywhere, so each part of it is moving away from every other part; only one place in the collection can hold still. If the growth is erratic with localized growth bubbles, as in the patent office, the problem may be even worse.

It appears that no known building geometry can solve the problems of rapid and/or erratic growth in sizable archives, libraries, or ordered collections. The same old boxey buildings are erected over and over again.

Some buildings have incorporated unusual geometries, but these have been adopted for architectural or artistic reasons rather than for any practical purpose. In buildings which have housed a collection the building geometry has not been related to the collection. One example is the Guggenheim Museum in New York City, which has a conical-helical (not spiral) geometry and houses an art collection placed along the helix in no apparent order. A new painting in the Guggenheims collection can be placed anywhere; as in a building of conventional geometry, the only relevant parameter is the size.

SUMMARY OF THE INVENTION

Growth problems in a collection can be solved by (1) physically arranging the collection linearly according to some classification scheme, and (2) providing for the collection items to be moved easily along the line. In this way space is easily opened up for new at any point to accommodate growth, no matter where in the collection it may occur.

Thus, the present invention in one embodiment includes a long, straight building with some means to move the collection items along the line. For example, a library could be built with all the bookcases on tracks, or wheels, so that they could be moved at any time. One end of the building would have the books indexed "1" (e.g., in Dewey decimal) and the other end would house the books indexed "999". As the collection grew, the "999" end could be extended by continually building additions at that end. (Of course, it could expand at both ends also.)

Until some insurmountable obstacle blocked further building extension this library could grow forever. The amount of book re-shelving would be minimal; gross movement of the books would be by wheeling the cases, and fine movement would be inserting new bookcases into the line and/or moving books along the shelves or from one case to the immediately adjacent case. Books would never need to be moved more than a few feet, and the collection would stay in order.

Once the insurmountable obstacle were reached, the long straight building could be jogged or turned, and if the cases were mounted on tracks the tracks would bend. Since most archives or collections are in cities, this would happen sooner rather than later.

Clearly, growth could also be accommodated if the turning were built in from the beginning, by making the building a spiral. A spiral is a generally planar curve; it is not the same thing as a helix (screw thread). As used here and in the following claims, "spiral" includes any curved or jogged line generally winding out from a central area. The invention includes a partially-helical building as well as a completely flat one; for example, a spiral built over a hill-top would be somewhat helical, but still a spiral within the present invention because it would follow the land surface.

A spiral is compact in diameter but has a great length. Thus, a large collection can be housed in a small region and its growth potential is much greater since obstacles are not reached so quickly. A helical building, such as the Guggenheim Museum, is more compact than a spiral as far as ground area but it does not have unlimited growth. A building can only go so high in the air, or so low into the ground, before it must stop. A flat building's length knows no structural bound. Also, construction for accommodating growth is much more difficult high in the air than on the ground. Thus, the spiral shape is better than a helical shape.

An additional benefit of the spiral shape over a long line is that the distance between any two parts of the collection is minimized. To permit travel between different portions of the spiral arm preferably a number of connecting "legs" radiate out from the central point, interconnecting points of the arm or arms.

The invention includes multiple interleaved or crossing spiral arms as well as a single arm. Several spirals can be laid on top of one another, preferably directly on top, for different collections or different portions of one collection. For example, the patent office divides all patents into one of three categories (generally chemical, electrical, and mechanical) and so a spiral patent office might have three stories. If the patent office changes to six categories as planned, a six-story spiral might be appropriate.

The spirals could also intersect on one level or story, e.g. on the ground. If built in stories with arms at different levels, the arms could spiral out in different senses, left-handed and right-handed, and criss-cross as seen in plan view.

Preferably the arm or arms would start at a central building, which would also house administrative offices, information desks, and other facilities not linked directly to the collection. Access to the central building would be through the legs. A roadway could circle the central building below grade, and loading docks, bus stops, and so on could be deployed around the circle.

The building could have one continuous corridor running along the spiral, housing the collection and any other furniture or facilities needed by researchers or collection users, such as photocopiers, tables, and computers. In a very large archive like the patent office, reception desks could also be wheeled or set on the tracks, so the librarians or other personnel attached to the collection could easily move along as the collection progressed down the line, and stay near their portion of the collection.

As the collection and its dedicated personnel and furniture moved outward away from the stationary end at the central building, construction to extend the arm could take place as needed to accommodate the collection's growth. In the case of the patent office, the growth would probably be continuous since the arm length would increase at about 500 feet per year.

There are several advantages to this invention:

(1) No planning for future growth is required, only enough acreage to hold the growing spiral.

(2) Personnel and equipment dedicated to a particular part of the collection stay close to that part.

(3) The order of the collection would never need to be disturbed. The classification could be modified as needed, instead of creating a new classification area. For example, if classification area 504.1 suddenly grew too large for one classification, new areas 504.10, 504.11, 504.12, . . . 504.19 could be created. The physical collection will not be jumbled, and neither will the classification scheme.

(4) The collection will be more compact because no buffer spaces are provided to accommodate growth. This means shorter distances between parts of the collection.

DETAILED DESCRIPTION OF THE PREFERRED EMBODIMENT

Here, and in the following Claims:

"building" means a permanent or semi-permanent structure for housing a collection, but does not imply any particular type of structure. For example, a single large room such like an airplane hangar, with a spiral collection on the floor, is within the scope of the claimed building. Exhibits or other items on track or tracks in the middle of a field, without walls or ceilings, are likewise within the scope of the present invention if the tracks are spiral.

"case" means any movable device housing a sub-set of a collection.

"collection" means a group of items stored, displayed, studied, researched, or otherwise housed in a building.

"house" means to contain, deploy, or arrange.

"item" includes, but is not limited to, any: information storage device or unit (document, book, diskette, magnetic tape, magazine, film, CD, videotape, etc.); artifact (archaeological, artistic, historical, etc.); display (painting, video monitor, etc.); and so on.

"spiral" includes any curved, jogged, or otherwise bent line generally winding out from a central area. It includes, but is not limited to, all the geometric shapes denoted as spirals, such as a logarithmic spiral, the spiral of Archimedes, and so on, and variations on those achieved by various kinds of imposed irregularity. A spiral may have one or any number of arms, winding either left-handedly or right-handedly, and be at any elevation and/or follow a gradually curved surface.

"track" means any guiding element, including not only mechanical guides but devices or methods using electronic, sonic, or EM-wave (light, microwave, etc.) energy.

Figure 1:
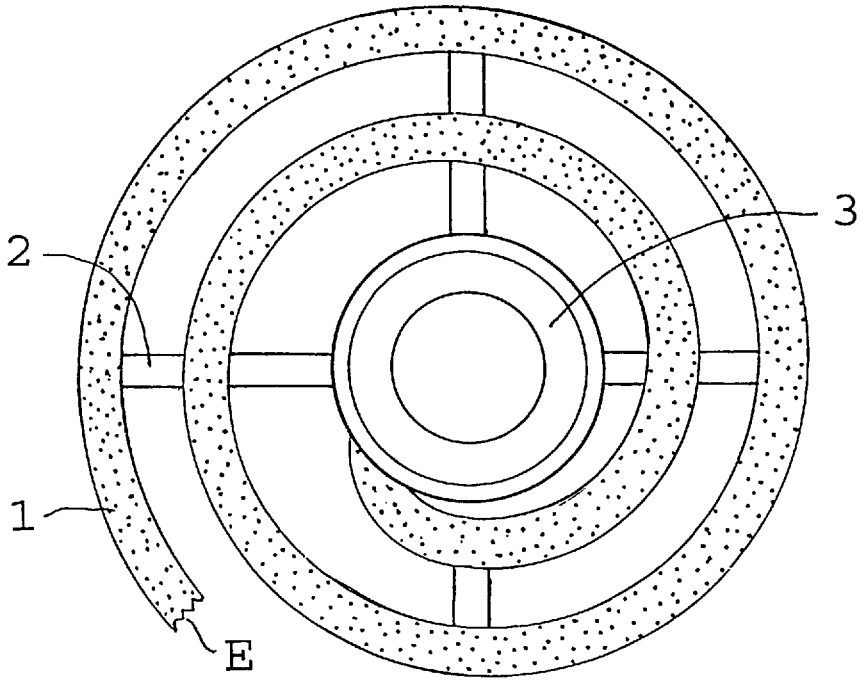
FIG. 1 is a plan view of a spiral building and a central building.

FIG. 1 shows a spiral building in plan view, as if from an airplane. A single spiral arm 1 winds outwardly from a central building 3, proceeding left-handedly. Legs 2 interconnect adjacent portions of the arm 1; they radiate from the central building 3 along four lines. The end E of the spiral arm 1 is where new portions of the arm 1 can be constructed.

The spiral shown in FIG. 1 is generally a spiral of equal spacing. That is, the radial distance between two adjacent portions of the arm 1 is constant throughout the spiral building. the leg interconnections are equal in length.

Only the roofs of the central building 3 and the spiral arm 1 are visible in FIG.1. The stippling represents, for example, a gravel roof.

Figure 2:
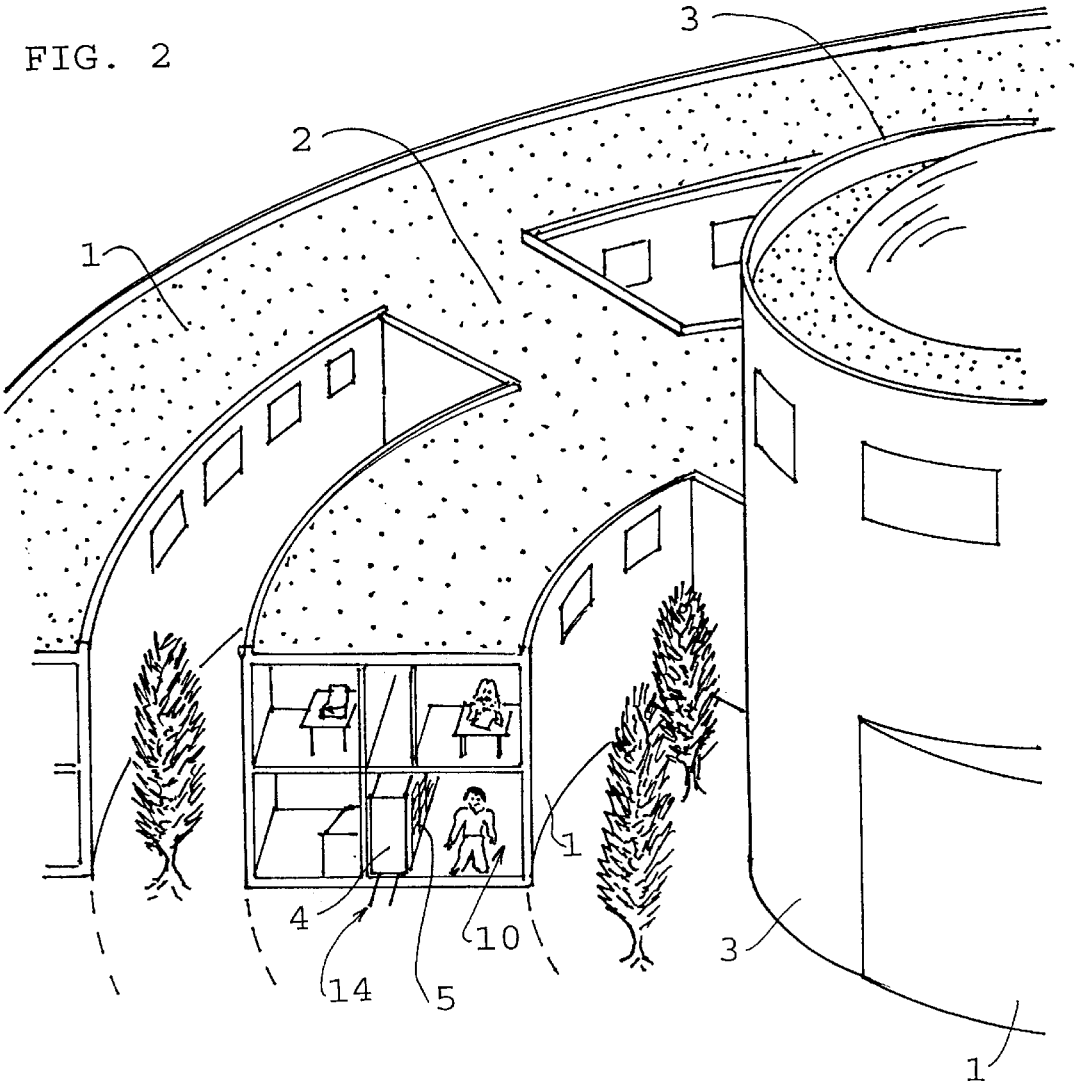
FIG. 2 is a perspective view of the spiral building, shown cut away.

FIG. 2 shows a building like that of FIG. 1 with the arm cut away; dashed lines show the extended part which is removed for illustration. The arm 1 veers out from the central building 3, which is cylindrical (other shapes can be used, or the central building 3 can be omitted).

Inside the arm 1 is a corridor 10 which preferably extends the length of the arm 1. inside the corridor 10 is a set of tracks 14 on which ride wheeled cases 4. The cases 4 contain the items of the ordered collection housed in the arm 1; the items are visible and are labeled as 5. The cases are preferably in linear order along the spiral, but their order in most cases will overlap the order of the items 5 and sub-sets of the item collection may be partially re-ordered within a case 4. The cases may be oriented in any direction and/or ganged without any order within a gang. For example, library shelves may be stacked, or a case may include stacked shelves; the books can run along these shelves either left or right, and the shelves can increase in order number up or down. The present invention includes all such small-scale disorders or re-orders.

Figure 3:
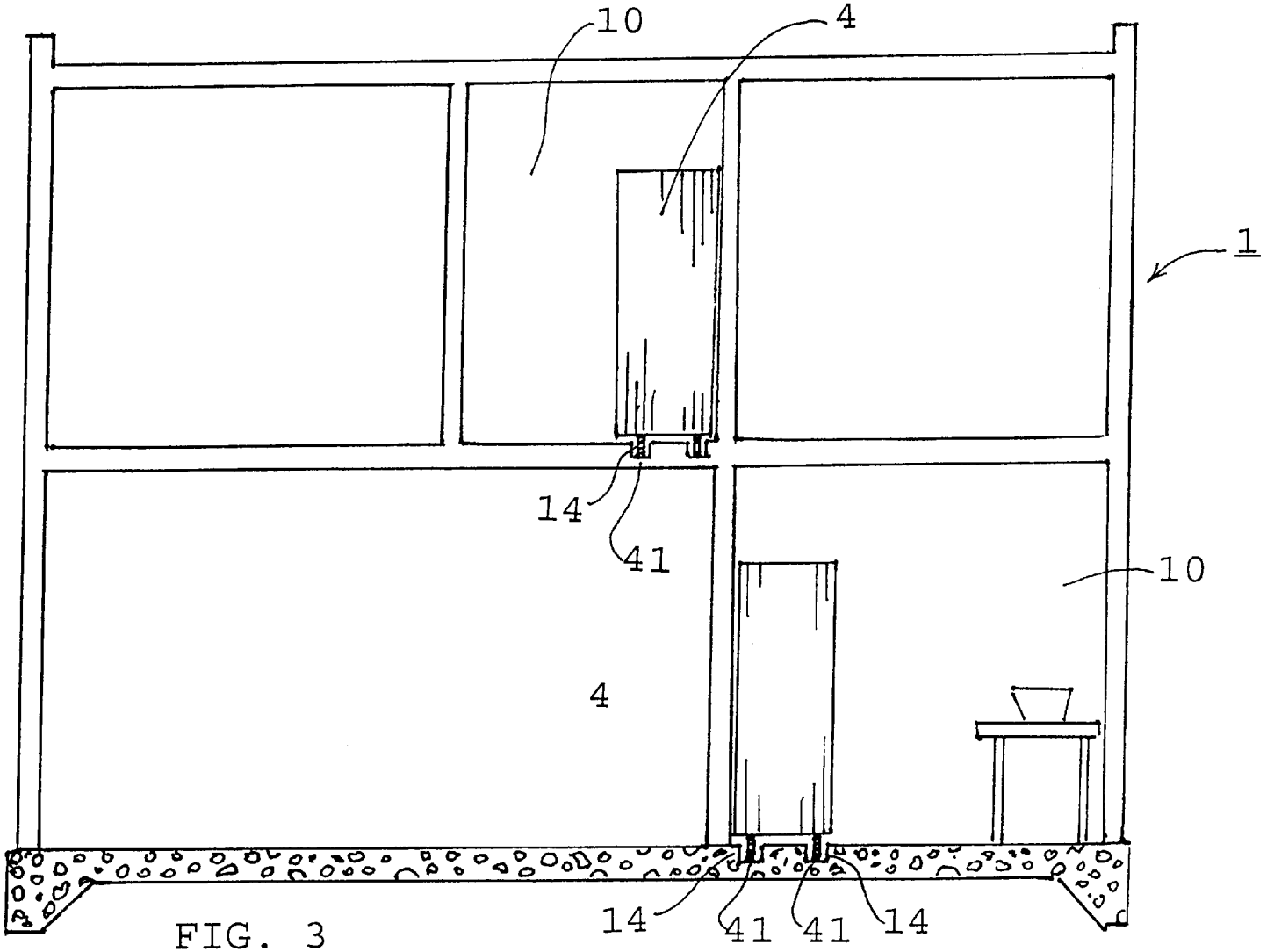
FIG. 3 is a cross-sectional elevational view of the spiral arm for a patent office.

The tracks 14 and cases 4 are also visible in FIG. 3, an elevational view roughly duplicating the cut-away view of the arm 1 in FIG. 2, but showing a second spiral set of cases 4 on an upper floor of the spiral building arm 1. In FIG. 3, the tracks 14 are embodied as recessed grooves in the floor which accept wheels 41 of the cases 4 shown extending into the track 14 grooves.

Any other sort of wheel and track, such as miniature railway track, is possible. The invention can include switches, turnarounds, and other conventional track modifications that vary from a strict spiral. Locomotives, motorized cases, and other power movers are within the scope of the invention. The tracks may be omitted in favor of floor-bearing wheels, such as castors, especially when the cases 4 are not too heavy. Other means for moving items or cases may used, such as ceiling or wall racks, air-pressure levitation, or any other method or device for moving things.

Figure 4:
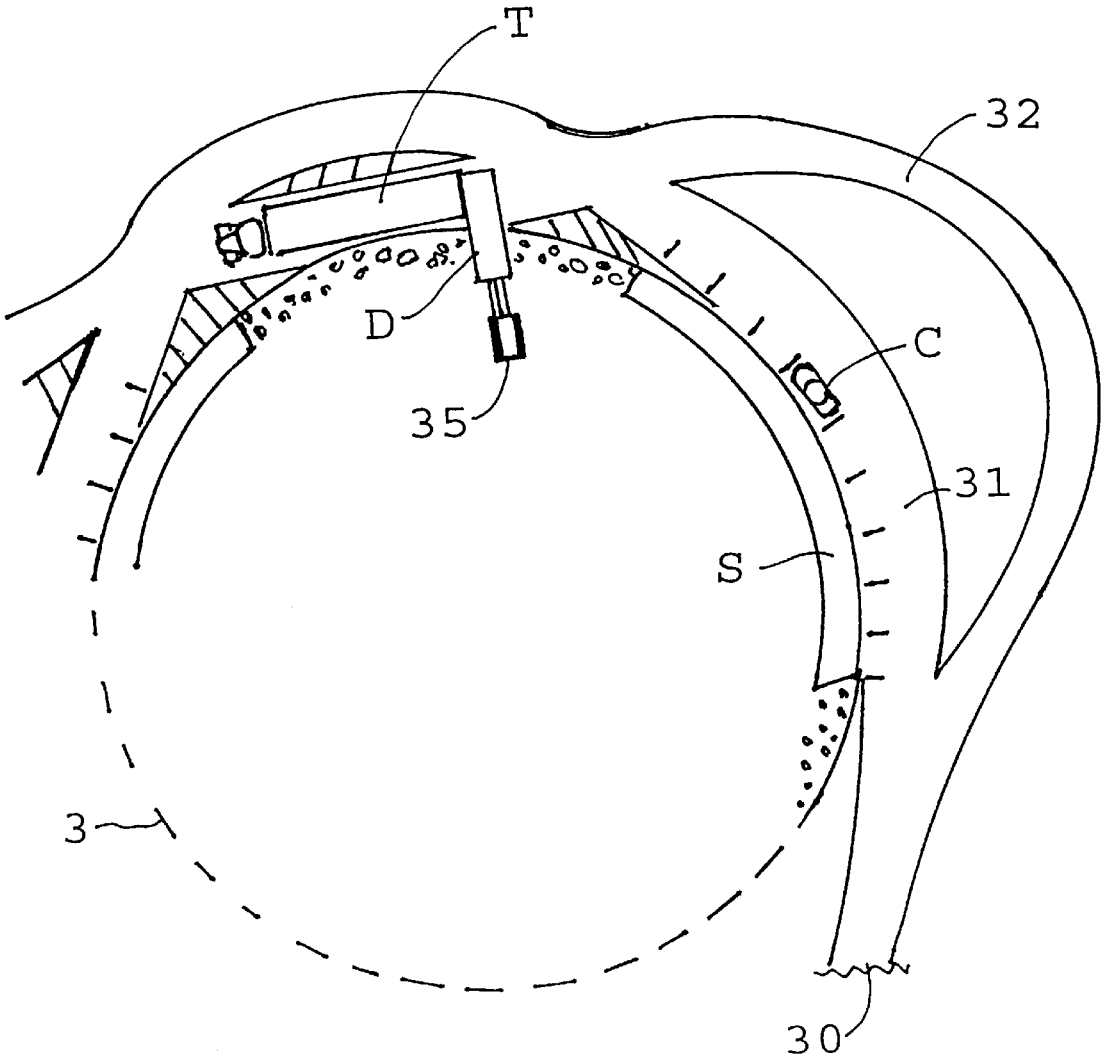
FIG. 4 is a plan view of an underground roadway.

FIG. 4 shows a roadway for the central building 3, which preferably is laid out one level under grade so that the arm 1 and legs 2 are built right over the roadway without any interference. A roadway 30 splits into two roadways, 31 for cars and 32 for trucks, which interweave. A car C is shown parked along a sidewalk S. A truck T is shown parked for loading or unloading. A movable loading dock D slides into or out of the roadway 32, pushed by a dock mover 35. When the a truck is approaching the dock D is retracted; when it is in position the dock D is extended just behind the truck's rear doors and at the standard truck dock height. Instead of sliding, the dock D could also fold down on hinges like a Murphy bed, rise up on hinges, rise out of the roadway on hydraulic power rams, and so on. The movable dock D allows the central building to function like any other building in terms of trucks, busses, and cars. Any other sub-level transport can be used also, such as railways, moving sidewalks, air tubes, and so on. All of these, and also utility lines, can be brought into the central building 3 below the arm level. In this way they will never be in the way of the expanding arm.

I claim:

1. In combination:

a spiral building including a spiral arm; and a collection of items having a linear classification scheme, the items being deployed along the arm according to the linear classification scheme.

2. The building according to claim 1, comprising a central building, and wherein the arm has a beginning end at the central building.

3. The building according to claim 2, comprising a roadway around the central building.

4. The building according to claim 3, wherein the roadway is at a level below an arm level, whereby the roadway passes under the arm.

5. The building according to claim 3, comprising a loading dock movable into and out of the roadway.

6. The building according to claim 1, comprising a plurality of arms vertically disposed in stories.

7. The combination according to claim 1, wherein the items are movable along the arm.

8. The combination according to claim 7, comprising item-holding cases movable along the arm.

9. For housing a collection of items;

a spiral building including a spiral arm, the items being deployable in order along the arm;

the items being movable along the arm; and including movable cases wherein the items are movable.

10. The building according to claim 9, wherein the cases include wheels.

11. The building according to claim 9, wherein the arm includes case-guiding track.

12. The building according to claim 9, wherein the cases include wheels and the building includes track matable with the wheels.

13. A building housing a collection of items, the items being deployed in order along a spiral, including means for moving the items along the spiral.

14. The building according to claim 13, wherein the structure for moving the items includes cases.

15. The building according to claim 14, wherein the cases include wheels.

16. The building according to claim 14, wherein the building includes generally spiral track for case-guiding track.

17. The building according to claim 14, wherein the cases include wheels and the building includes generally spiral track matable with the wheels.

* * * * *